US005688210A

United States Patent [19]

Chou

[11] Patent Number: 5,688,210

[45] Date of Patent: Nov. 18, 1997

[54] SWIM-EXERCISE EQUIPMENT

[76] Inventor: Chi-Hui Chou, P.O. Box 96-405, Taipei 10098, Taiwan

[21] Appl. No.: 595,622

[22] Filed: Feb. 2, 1996

[51] Int. Cl.[6] ..... A63B 23/035

[52] U.S. Cl. ..... 482/56; 482/121; 482/123; 482/129; 482/139

[58] Field of Search ..... 482/51, 55, 56, 482/121, 122, 123, 129, 130, 139, 142, 148, 908; 601/23, 24; 434/254

[56] References Cited

U.S. PATENT DOCUMENTS 5,013,035 5/1991 Nathaniel ..... 482/129

FOREIGN PATENT DOCUMENTS 3301738 7/1984 Germany ..... 482/56
935101 6/1982 U.S.S.R. ..... 601/24
961723 9/1982 U.S.S.R. ..... 482/56
2257921 1/1993 United Kingdom ..... 482/129

*Primary Examiner*—Richard J. Apley
*Assistant Examiner*—Jeanne M. Clark
*Attorney, Agent, or Firm*—Bacon & Thomas

[57] ABSTRACT

A swim-exercise device having a main frame and a balance frame; the main frame has a U-shaped frame, of which a lateral rod is mounted with two vertical dampers; the lower end of each vertical damper is connected with a foot supporting assembly. Two vertical rods of the main frame have two horizontal dampers and two pull elements respectively. The balance frame includes two supporting frames and a balance pad, and several elastic elements mounted between the supporting frames and the balance rod. The balance frame is used for supporting a user's chest and belly portions; the user's feet are mounted in the foot supporting assemblies respectively, while the hands grip the two grip rings on the pull elements respectively so as to imitate a swimming motion.

15 Claims, 6 Drawing Sheets

SWIM-EXERCISE EQUIPMENT

BACKGROUND OF THE INVENTION

1. Field of the Invention

This invention relates to an exercise equipment, and particularly to a swim-exercise equipment for a user to use the body, hands and feet.

2. Description of the Prior Art

Most of the conventional exercise equipment are usually designed for exercising a specific muscle, such as a chest expander, a leg-lifting set, an arm-pulling set, etc.. Also, some equipment is used for a person's exercise posture, such as boating equipment, a running slow set, a skiing set, or a versatile exercise equipment.

SUMMARY OF THE INVENTION

The prime object of the present invention is to provide a swim-exercise device, which is designed in accordance with human swimming posture for imitating a swimming motion.

Another object of the present invention is to provide a swim-exercise device, which comprises a main frame and a balance frame; a U-shaped frame of the main frame having a lateral rod mounted with dampers and foot supporting assemblies. The inner side of a vertical rod of the U-shaped frame has a damper and a pull element gripped by a user. Several elastic elements are mounted between the balance pad and the supporting frame of the balance frame. When in use, a user's chest and belly portions lie on the balance frame, while the user's feet engage the foot supporting assemblies respectively under the vertical dampers; the use's hands grip two grip rings at one end of the pull elements respectively. The body portion of the user will swing automatically upon the arms moving upon and down.

Still another object of the present invention is to provide a swim-exercise device, in which the balance frame includes two supporting frames, a balance pad and several elastic elements; the bottom of the supporting frames are mounted on two bottom rods respectively set on a ground surface. The supporting rod mounted on the bottom rod is a U-shaped rod; the horizontal rod portion of the supporting rod is furnished with two symmetrical sockets for mounting one end of the elastic element, while other end thereof is connected with bottom side of the balance pad; the top side of the balance pad is used for supporting a user's body in a floating manner.

A further object of the present invention is to provide a swim-exercise device, in which a U-shaped frame of the main frame is mounted with two symmetrical vertical dampers; each vertical damper having an elastic element between two supporting plates; the elastic element is made of an elastic belt, or a spring or the like. One end of the elastic element is connected with a lug on the lateral rod, while the other end thereof is connected with a pending lug of the foot supporting assembly. The dampers are used for providing a counter-force to a user's feet during exercise.

A still further object of the present invention is to provide a swim-exercise device, in which each horizontal damper on the main frame includes two supporting plates and an elastic element mounted between the two supporting plates; the elastic element made of an elastic belt, or a spring or the like; one end of the elastic element is connected with a lug of a vertical rod, while the other end thereof is connected with one end of the pull element, which is a belt with a given length; one end of the belt is connected with a grip ring. The horizontal damper can provide a counter-force when a user's arms move up and down, as in water.

Yet another object of the present invention is to provide a swim-exercise device, in which each foot supporting assembly includes a base plate, an elastic pad and a fastening. belt. The top side of the base plate has a pending lug connected with the vertical damper; the base plate is formed into a heel-portion shape, and inside thereof is furnished an elastic pad; two fastening belts are mounted on both sides thereof; a user's feet can easily engage the supporting assembly.

Yet still another object of the present invention is to provide a swim-exercise device, in which the foot supporting assembly under the vertical damper is connected with a supporting plate on the lower end of the vertical damper by means of a detachable safety pin. The base plate and the fastening belt can be set in advance a suitable tightness to a user's feet before engaging the foot supporting assembly to the supporting plate of the damper.

DETAILED DESCRIPTION OF THE PREFERRED EMBODIMENTS

Figure 1:
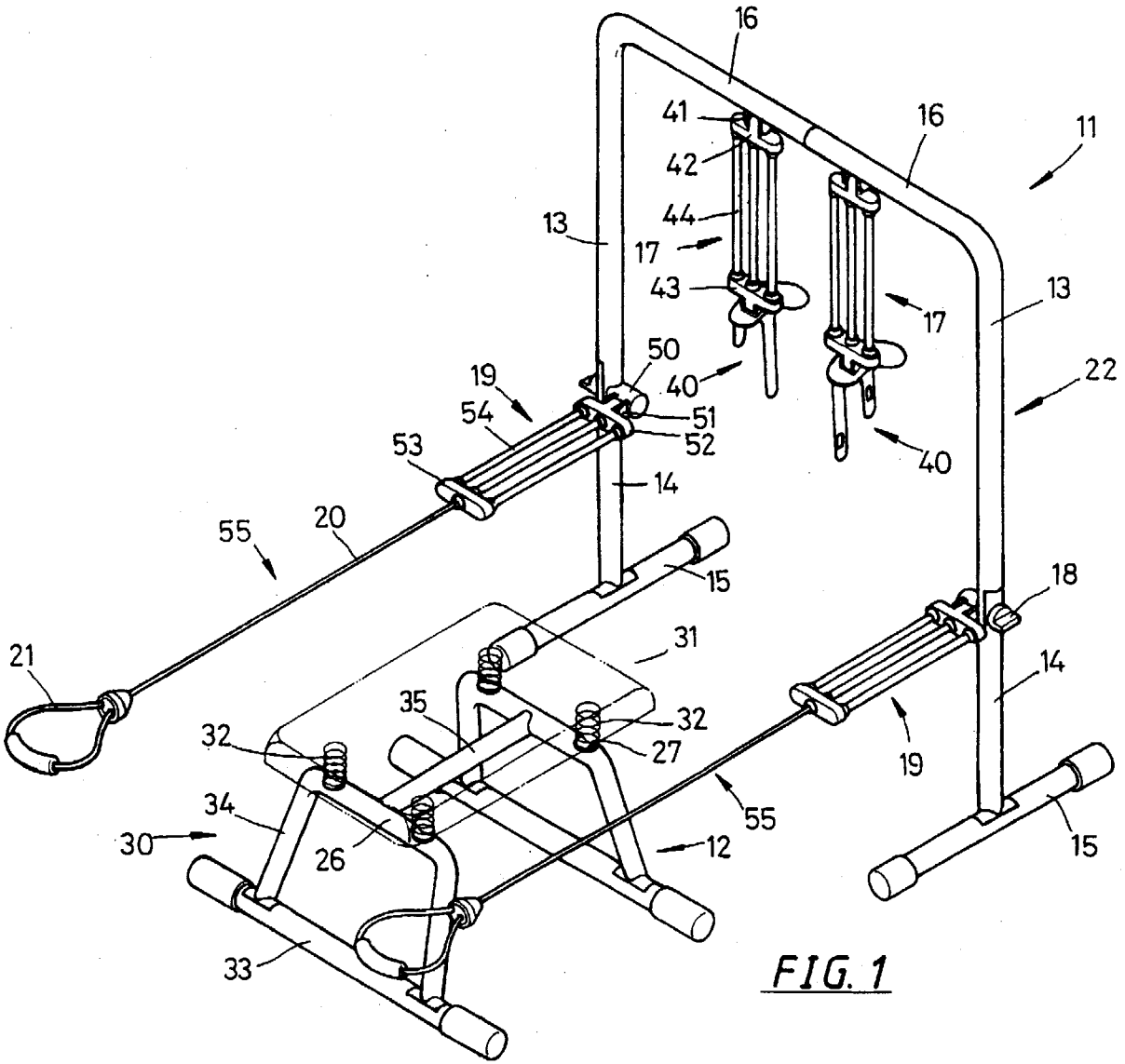
FIG. 1 is a perspective view of an embodiment according to the present invention, showing the structure of the main frame and the balance frame thereof.
Figure 2:
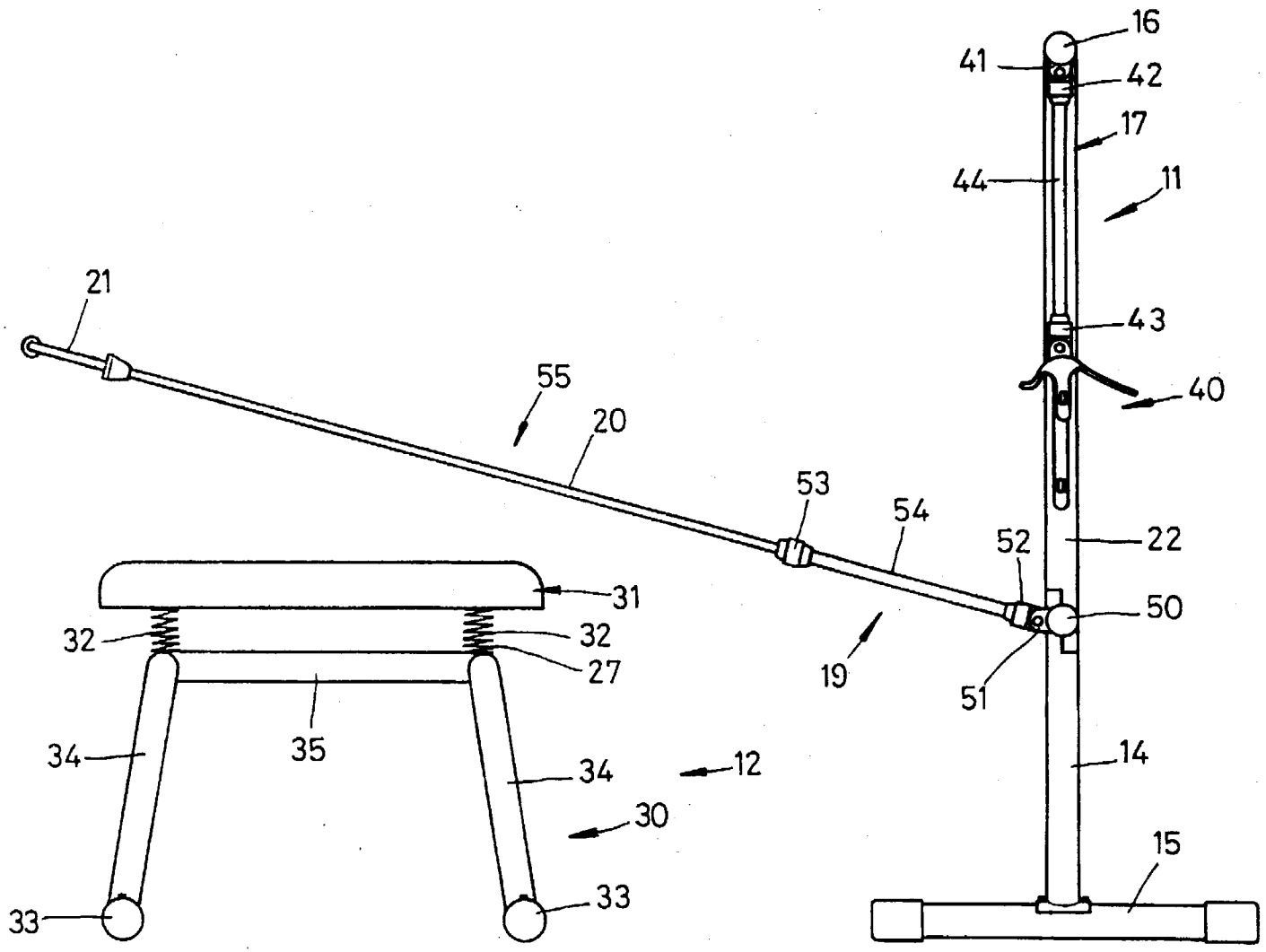
FIG. 2 is a side view of the present invention, showing the structure of the main frame and the balance frame thereof.
Figure 3:
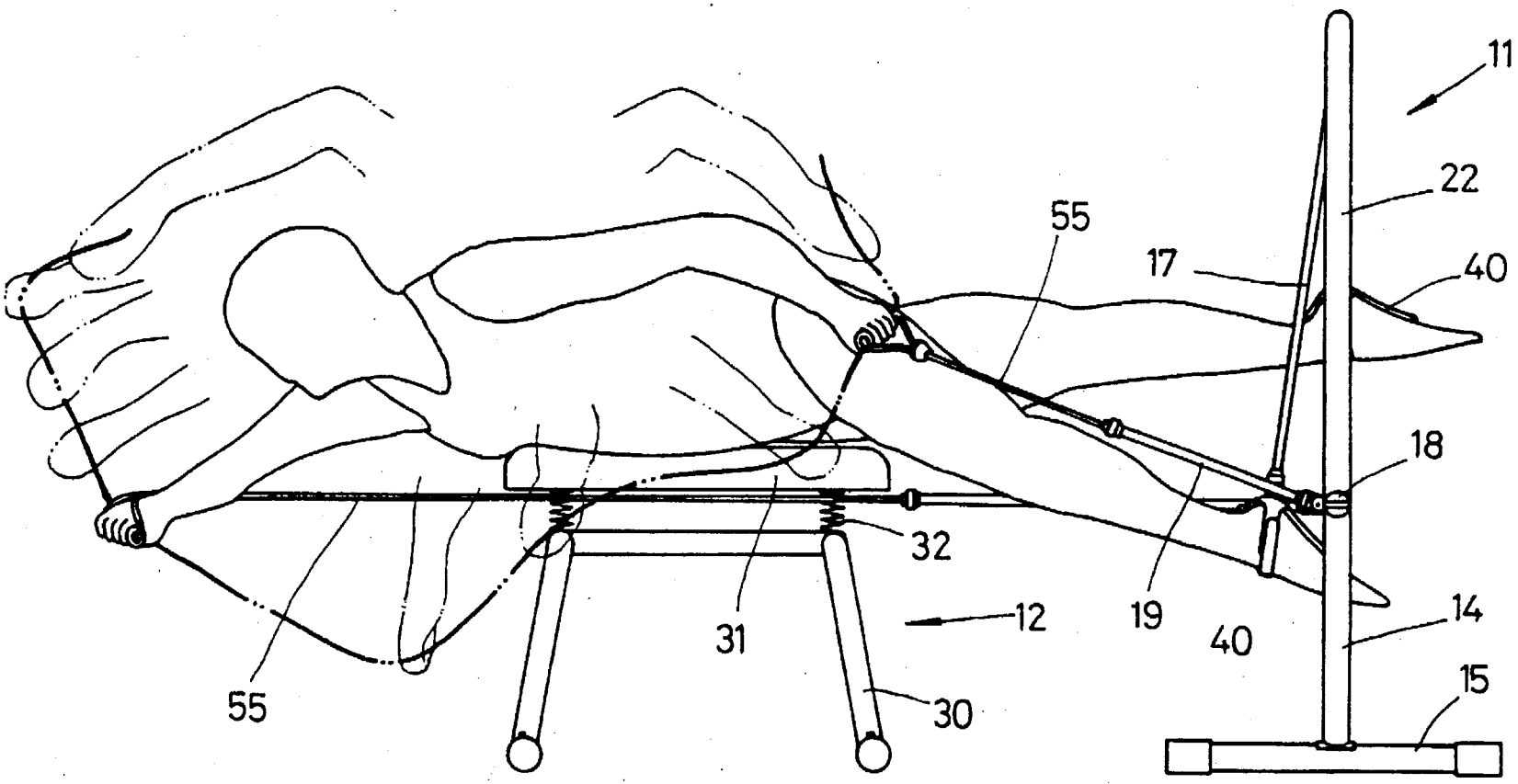
FIG. 3 is a side view of the present invention, showing a user doing a swimming exercise.

Referring to FIGS. 1 to 3, the present invention relates to a swim exercise device, which comprises a main frame 11 and a balance frame 12. The main frame 11 includes a U-shaped frame 22, of which the lateral rod 16 is mounted with two vertical dampers 17; the lower end of each vertical damper 17 is connected with a foot-supporting assembly 40. Each of the two vertical rods 14 is mounted with a horizontal damper 19 and a pull element 55. On the balance frame 12, there are elastic elements 32 mounted between the supporting frame 30 and the balance pad 31. The balance frame 12 is used to support a user's chest and belly portions; the feet of a user are engaged in the two supporting assemblies 40 on the lower end of the vertical dampers 17 respectively, while the user's two hands grip the two grip rings 21 of the pull elements 55 on the ends of the horizontal dampers 19 respectively so as to enable a user to imitate a swimming exercise.

As shown in FIGS. 1 to 3, the main frame 11 includes a U-shaped frame 22, two bottom rods 15, two vertical dampers 17, two supporting assemblies 40 for the user's feet, two horizontal dampers 19, and two pull elements 55. The U-shaped frame 22 includes two L-rods 13, two vertical rods 14 and two connecting elements 50 so as to facilitate disassembling and shipping if necessary. The upper portions of the two L-rods 13, form the lateral rod 16, on which are mounted two lugs 41 to be connected with two vertical dampers 17 respectively and symmetrically. Between the L-rod 13 and the vertical rod 14, there is an adjusting knob 18 for adjusting the slanting angle of the L-rod 13, if necessary. The inner side of the vertical rod 14 and the adjusting knob 18 are mounted with a connecting element 50, of which the lug 51 is connected with the horizontal damper 19. The lower end of the vertical rod 14 is connected with a bottom rod 15 to provide the U-shaped frame 22 with a supporting force.

Figure 7:
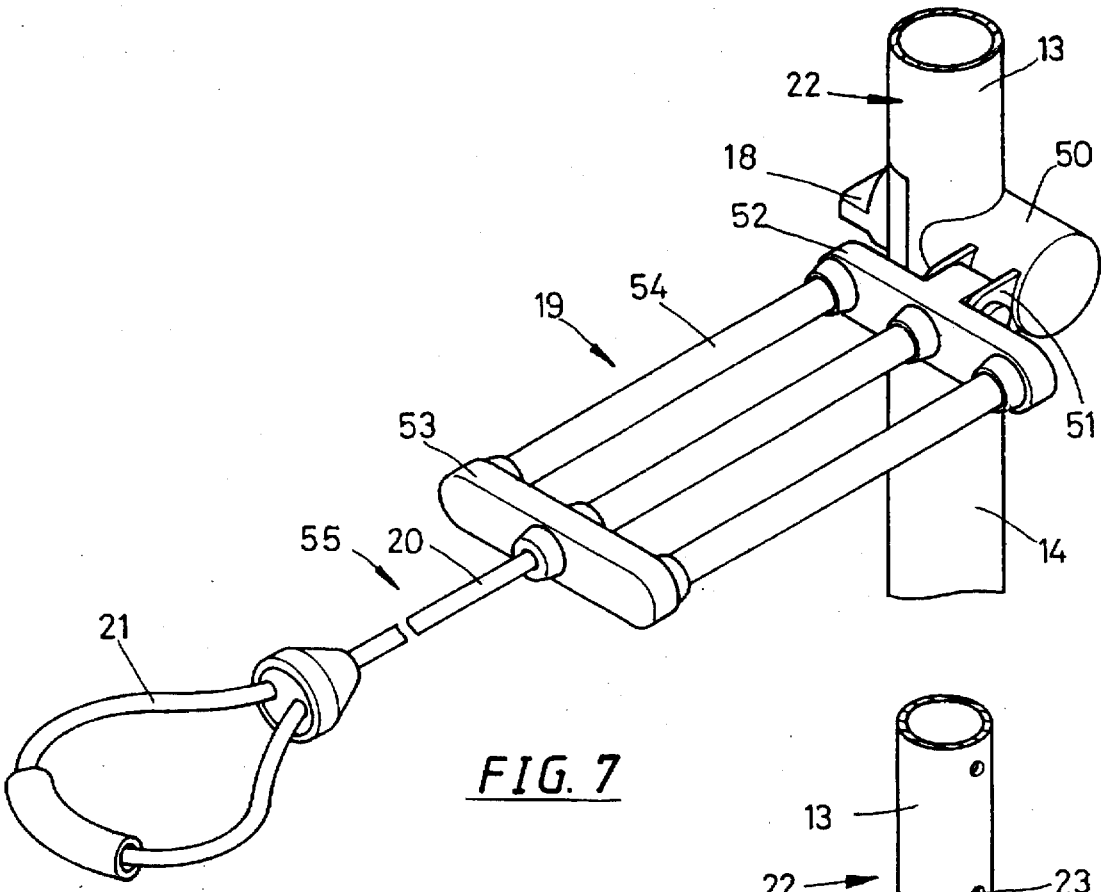
FIG. 7 is a perspective view of a first embodiment of a horizontal damper according to the present invention.
Figure 8:
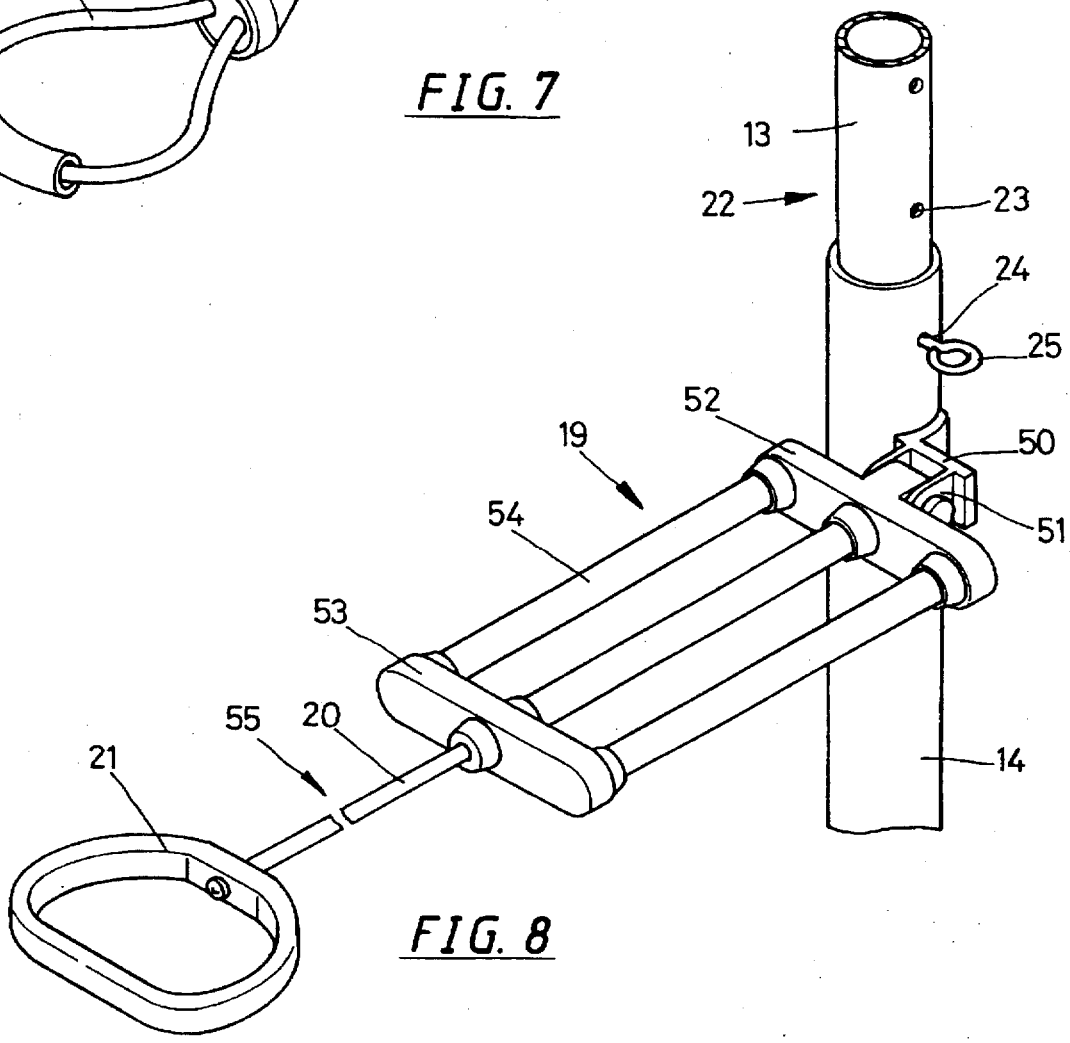
FIG. 8 is a perspective view of a second embodiment of a horizontal damper according to the present invention.
Figure 9:
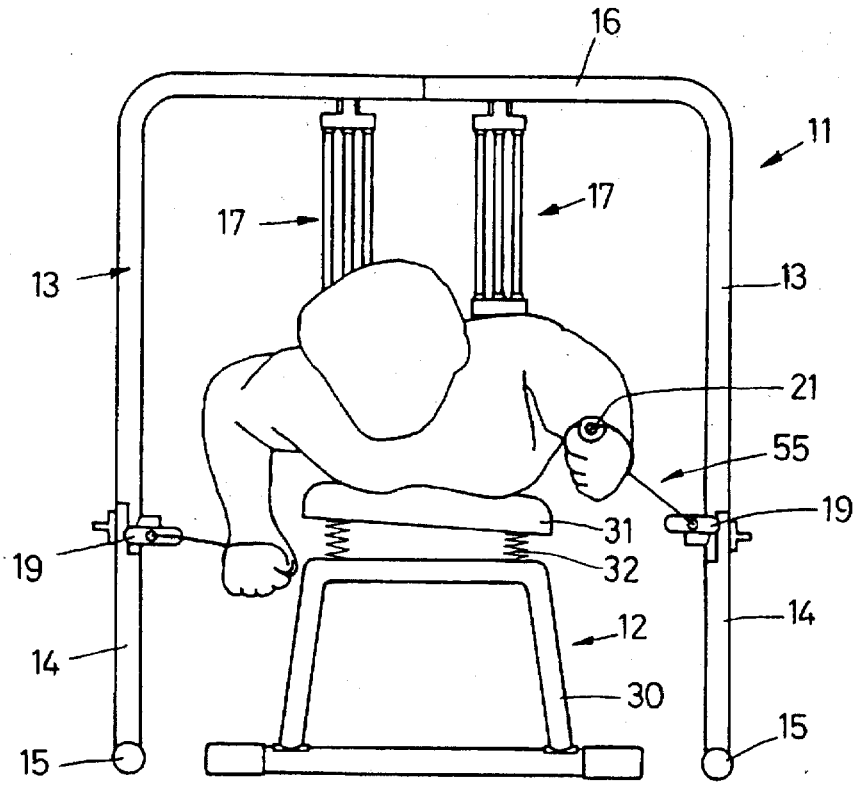
FIG. 9 is a front view of the present invention, showing a user doing a swimming exercise.
Figure 10:
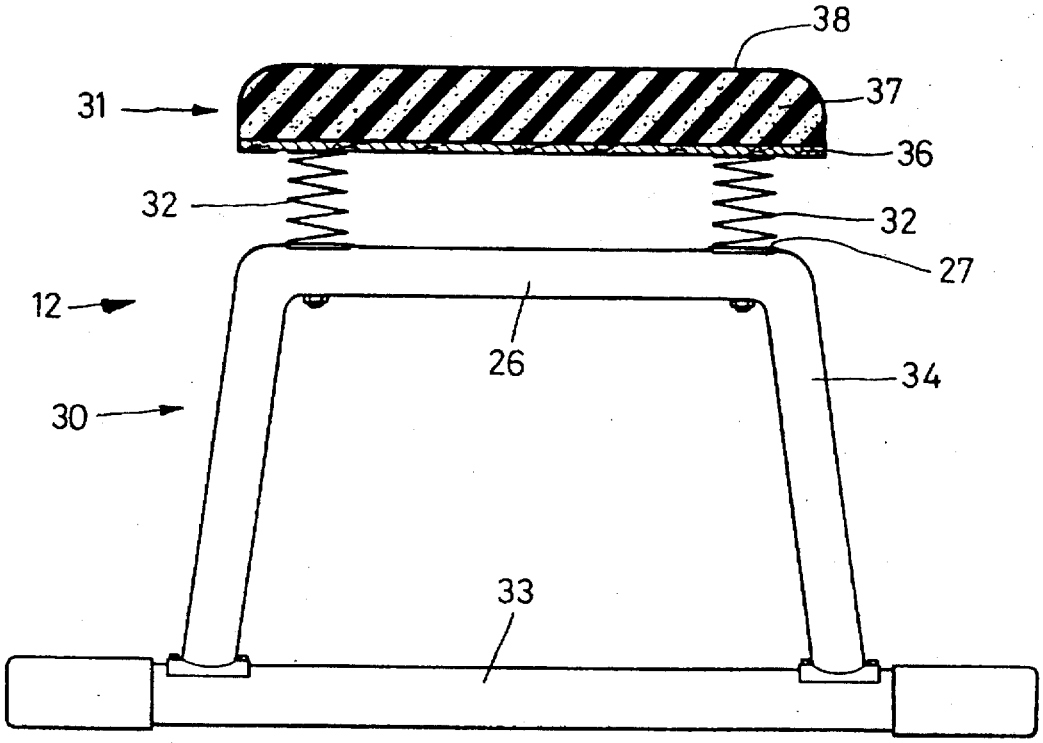
FIG. 10 is a front view of the balance frame according to the resent invention.

As shown in FIGS. 1 and 7, the vertical rod 14 and the L-rod 13 are connected together with a sleeve-connection method; the outer side of the rod is furnished with an adjusting knob 18 for adjusting the slanting angle of the vertical rod 14. The opposite end of the adjusting knob 18 is mounted with a connecting element 50, which is preferably a round shaped member in order to fit with the adjusting knob 18. A second embodiment is shown in FIG. 8 wherein the U-shaped frame 22 is not furnished with the angle-adjusting member, and the vertical rod 14 and the L-rod 13 are connected together by means of a sleeve connection method; the inner side of the vertical rod 14 is mounted with a bracket-shaped connecting element 50, which has a lug 51 for connecting with a horizontal damper 19. The L-rod 13 and the vertical rod 14 are connected together by means of a sleeve connection method. The height of the U-shaped frame 22 can be adjusted by means of the adjusting holes 23, 24 on the L-rod 13 and the vertical rod 14 and a pin 25 for fixing the height adjusted so as to provide the user with a suitable height adjustment for the users feet.

As shown in FIGS. 1 to 6, the lower side of the lateral rod 16 of the U-shaped frame 22 has two symmetrical lugs 41, which are connected with two vertical dampers 17 respectively; each of the vertical dampers 17 includes two symmetrical supporting plates 42 and 43 and elastic elements 44; the elastic elements 44 are mounted between the two supporting plates 42 and 43, and are elastic belts, springs, or the like so as to have the damper 17 return to the original condition after being pulled. The lower end of the supporting plate 43 of the damper 17 is famished with a pending lug to be mounted in place with a safety pin 39, and to be connected with a foot supporting assembly 40.

The foot supporting assembly 40 includes a base plate 45, an elastic pad 46 and a fastening belt 47; the base plate 45 is made of a rigid metal; the inner side of the base plate 45 is attached to an elastic pad 46. A fastening belt 47 is mounted between the base plate 45 and the elastic pad 46. The top side of the base plate 45 is famished with a lug 49 to be connected with the supporting plate 43 by means of a pin 39. The inner surface of the base plate 45 is glued to an elastic pad 46; the inside space of the base plate 45 is formed into a recess seat 60 to fit a user's heel portion. The front end of the recess seat 60 is provided with an extended plate 61, while the rear end of the recess seat 60 is provided with a soft edge 62 to provide a close contact with the user's heel portion. The length of the front extended plate 61 may be extended to a center of the foot so as to facilitate the front end of a foot to hook, to bend and to extend freely, or may be extended to the toe portion so as to have the whole foot come into contact therewith.

The foot supporting assembly 40 and the vertical damper are connected together by means of the pin 39. The foot supporting assembly 40 is mounted under the vertical damper 17; in use, a user should remove the foot supporting assembly 40 from the vertical damper 17 first before engaging his (or her) foot heel; then, the fastening belt 47 on both sides of the recess seat 60 is fastened around the user's foot at a suitably tight condition so as to facilitate taking off later. After the foot supporting assembly 40 is mounted under the vertical damper 17, the user's feet can easily be mounted into the space between the fastening belt 47 and the recess seat 60.

Figure 4:
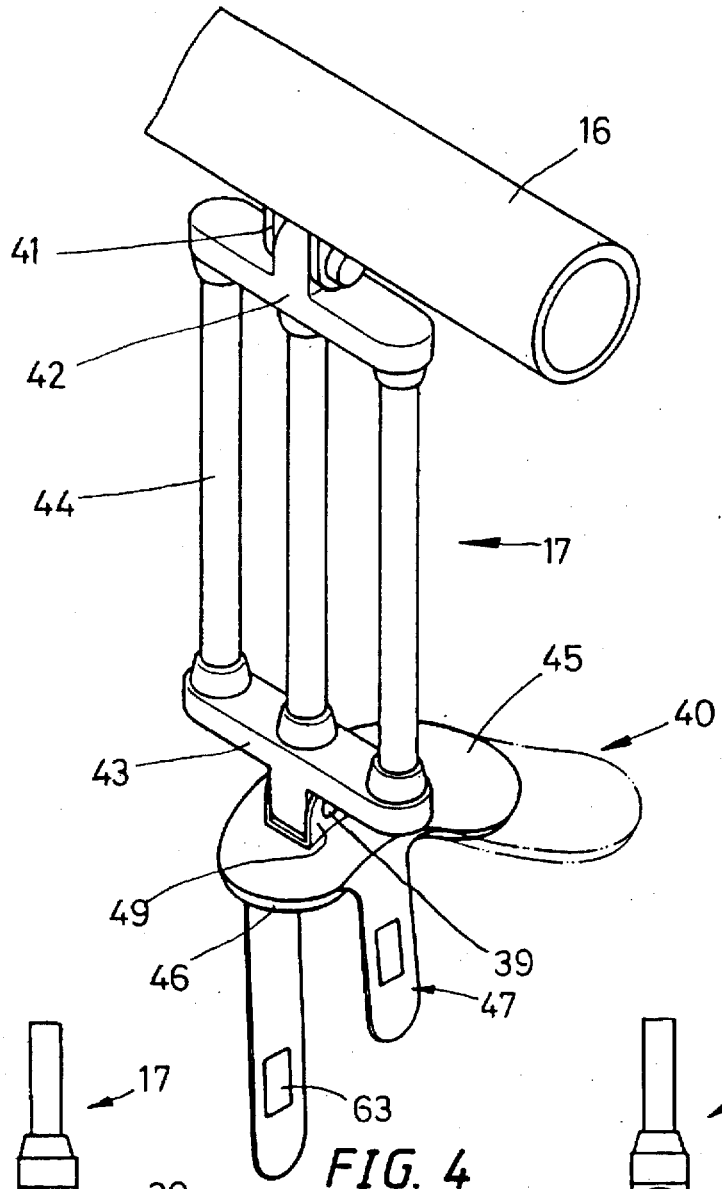
FIG. 4 is a fragmental perspective view of the present invention, showing a damper thereof.
Figure 5:
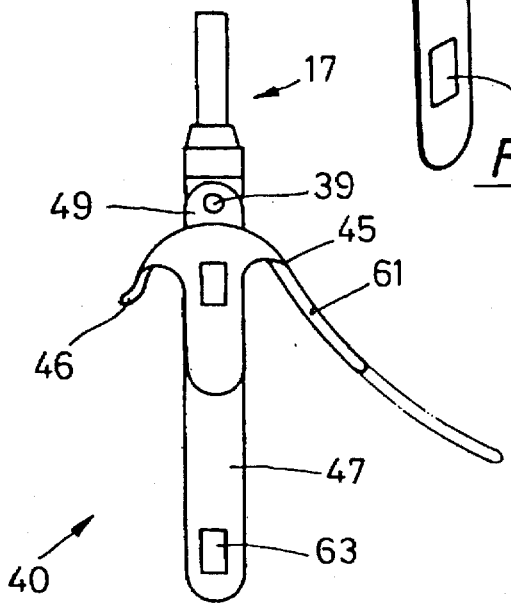
FIG. 5 is a side view of a first embodiment of a supporting assembly of the present intention.
Figure 6:
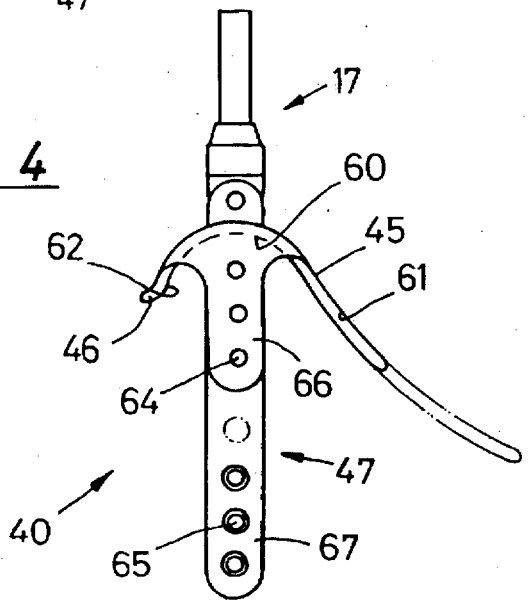
FIG. 6 is a side view of a second embodiment of a supporting assembly of the present invention.

As shown in FIGS. 4 and 5, the fastening belt 47 between the base plate 45 and the elastic pad 46 is made of a hook and loop fastener tape 63. As shown in FIG. 6, the belt portion 66 of the fastening belt 47 is provided with a plurality of fastening studs 64, while the other belt portion 67 is provided with a plurality of round holes 65; the two belt portions can be adjusted at a suitable length by means of the fastening means thereof; such fastening means has widely been used in sports caps.

As shown in FIGS. 1, 7 and 8, one end of the horizontal damper 19 is connected with a connecting element 50 on the inner side of the vertical rod 14; one type of the connecting element 50 is a round rod with lugs 51, while the other type thereof is a bracket-shaped one with lugs 51. The lugs 51 are used for connecting one end of the horizontal damper 19; The horizontal damper 19 includes two symmetrical supporting plates 52 and 53, and elastic elements 54 mounted between the two supporting plates. The elastic elements 54 are made of elastic belts, springs, or the like so as to facilitate the return of damper 19 to the original condition after being pulled.

The outer side of the supporting plate 53 of the horizontal damper 19 is provided with a lug or a connecting ring to connect with the pull element 55.

The pull element 55 includes a pull strap 20 and a grip ring 21; the pull strap 20 is made of a non-woven cloth having a slight elasticity; one end of the pull strap 20 is connected with the supporting plate 53, while other end thereof is connected with the grip ring 21; the grip ring 21 is to be gripped by a user's hand. When the user's body is set horizontally on the balance frame 12, in a swimming posture, the hands and the body of a user will move up and down together with the balance frame 12.

As shown in FIGS. 1 to 3, 9 and 10, the balance frame 12 includes a balance pad 31, elastic elements 32 and a supporting frame 30; the balance pad 31 is a rectangular member, which includes a base plate 36, a foam-rubber block 37 and a cover layer 38. The base plate 36 is made of wood; the foam-rubber block 37 is made of a rigid PU material. The cover layer 38 is made of a cloth or artificial leather. The supporting frame 30 includes bottom rods 33, supporting rods 34 and a connecting rod 35, which are assembled together in a detachable manner so as to facilitate shipping; the supporting rod 34 is a U-shaped member, of which the lower end is furnished with a small connecting plate for connection with the bottom rod 33. The top of the two supporting rods 34 is connected with a connecting rod 35. The horizontal rod portion 26 of the supporting rod 34 is furnished with at least two sockets 27 to be fitted and positioned with two elastic elements 32 respectively; The other ends of the elastic elements 32 are connected with the base plate 36 under the balance pad 31. Between the balance pad 31 and the supporting frame 30, a plurality of elastic elements 32 are mounted so as to provide a horizontal balance upon a user lies on the balance pad 31 without declining.

Referring to FIGS. 1 to 3 and 9, before a user lies on the balance frame 12, the distance between the supporting frame 30 and the main frame 11 should be set properly in advance; the height between the U-shaped frame 22 and the vertical rod 14 should also be set properly in advance; the tightness of the foot supporting assembly 40 under the vertical damper 17 should also be well adjusted in advance. After a person lies on the balance pad 31 of the balance frame 12, the user's toes can directly engage the space between the fastening belt 47 and the elastic pad 46 of the foot supporting assembly 40 so as to have the feet mounted into the recess seats 60 inside the fastening belt 47 respectively. Since the user's heels are limited with the recess seats 60, the user's feet can be hung under the vertical dampers 17. The user's two hands on both sides of the balance frame 12 can easily grip the grip rings 21 on the pull elements 55 respectively. When a user imitates a swimming motion, the hands will be moved above the body portion; the user's arm will extend straight to move forwards, i.e., the arm moves s straight, downward and backwards; simultaneously, the user's body on the balance frame 12 will swing together with the shoulder potion. In that time, the user's arms will be hindered and resisted with the horizontal dampers 19 and the pull elements 55, i.e., the arms will have a counter-force. The feet in the foot supporting assemblies 40 under the vertical dampers 17 will extend straight and pull downwards, and then bend repeatedly to produce a counter-force as a result of the vertical dampers 17 so as to apply the counter-force to the feet.

According to the aforesaid description of the embodiment, the features and structure of the present invention have been disclosed completely; it is apparent that considerable improvement has been made by the present invention, and it is never anticipated by any one who is skilled in such art; therefore, the present invention is deemed unique in terms of structure.

I claim:

1. An exercise apparatus for simulating a swimming motion comprising:

a U-shaped frame having two vertical legs, each having a lower end and an upper lateral rod;

a pair of bottom rods, one rod connected to a respective lower end of the vertical legs to form feet upon which the frame is supported on a supporting surface;

a pair of connecting members, each connecting member mounted to a respective one of the vertical legs on an inside surface;

two arm dampers, each mounted horizontally to a respective one of the connecting members at a first end, each said arm damper includes a first supporting plate at said first end, a second supporting plate at a second end and elastic elements connected between the two supporting plates;

two pull elements, each element connected at a first end to a respective one of said second supporting plate of said arm dampers;

two grip rings, each ring connected to a second end of a respective one of the pull elements;

two leg dampers, each mounted vertically to said lateral rod at a first end, each said leg damper includes a first supporting plate at said first end, a second supporting plate at a second end and elastic elements connected between the two supporting plates;

two foot supporting assemblies, each foot assembly connected to a respective one of said second supporting plate of said leg dampers, each assembly having means to fit a user's foot; and, a bench including a supporting frame, a balance pad and a plurality of elastic elements mounted between said supporting frame and said balance pad wherein said bench is positioned in relation to said U-shaped frame so as to allow the user to lie in a prone position on the bench, insert his feet into the foot supporting assemblies, grab the grip rings with his hands and perform exercises simulating swimming motions.

2. The apparatus as cited in claim 1 wherein said U-shaped frame is comprised of two L-shaped rods connected together to form said upper lateral rod and said vertical legs, and further including two vertical rods which are connected to a respective one of said vertical legs wherein said bottom rods are connected to said vertical rods.

3. The apparatus as cited in claim 2 wherein said vertical legs and said vertical rods are connected by a connecting means, including an adjustment knob, for adjusting the slanting angle of said vertical legs with respect to said vertical rods.

4. The apparatus as cited in claim 2 wherein said vertical legs and said vertical rods are connected by telescopic means including holes in the vertical legs and vertical rods and a pin that is adapted to be inserted into said holes to adjust the height of the upper lateral rod of the U-shaped frame.

5. The apparatus as cited in claim 1 wherein said connecting member is a round rod member having a lug to connect said arm dampers.

6. The apparatus as cited in claim 1 wherein said connecting member is a bracket member with a lug to connect said arm dampers.

7. The apparatus as cited in claim 1 herein said elastic elements of said arm and leg dampers are elastic bands.

8. The apparatus as cited in claim 1 wherein said elastic elements of said arm and leg dampers are springs.

9. The apparatus as cited in claim 1 wherein said pull strap is made of a non-woven cloth having a slight elasticity.

10. The apparatus as cited in claim 1 wherein said means to fit a user's foot include a base plate made of rigid metal, an elastic pad glued to the side of said base plate opposite of said second supporting plate and a fastening belt connected between said base plate and said elastic pad.

11. The apparatus as cited in claim 10 wherein said base plate includes a recess seat and further includes an extended plate at one end of the base plate.

12. The apparatus as cited in claim 10 wherein said fastening belt includes two belt portions, each belt portion with a free end having hook and loop fasteners so as to fasten said two belt portions together in an adjustable manner.

13. The apparatus as cited in claim 10 wherein said fastening belt includes two belt portions, each said belt portion having a free end, one of said free ends includes fastening studs and the other of said free ends includes a plurality of holes so as to fasten said two belt portions together in an adjustable manner.

14. The apparatus as cited in claim 1 wherein said supporting frame includes two bottom rods, two U-shaped supporting rod connected to a respective one of said bottom rods and a connecting rod horizontally connected between said two U-shaped supporting rods wherein said connecting rod includes several sockets along its horizontal length capable of receiving a first end said elastic elements of said bench.

15. The apparatus as cited in claim 14 wherein said balance pad is square and includes a rigid base plate, a foam-rubber block mounted on said base plate and a cover layer mounted on said rubber block, wherein a second end of said elastic element of said bench are connected to said base plate.

* * * * *